US008167291B2

(12) United States Patent
Parks et al.

(10) Patent No.: US 8,167,291 B2
(45) Date of Patent: May 1, 2012

(54) PIN STOP JAW PLATE

(75) Inventors: Daniel C. Parks, Huber Heights, OH (US); Derrick Bunke, Jackson Center, OH (US); Kevin J. Moeder, West Minton, OH (US)

(73) Assignee: TE-CO Manufacturing, LLC, Union, OH (US)

( * ) Notice: Subject to any disclaimer, the term of this patent is extended or adjusted under 35 U.S.C. 154(b) by 446 days.

(21) Appl. No.: 12/434,649

(22) Filed: May 3, 2009

(65) Prior Publication Data

US 2009/0273132 A1 Nov. 5, 2009

Related U.S. Application Data

(60) Provisional application No. 61/126,597, filed on May 5, 2008.

(51) Int. Cl.
*B25B 1/24* (2006.01)
*B25B 5/16* (2006.01)

(52) U.S. Cl. ..... 269/261; 269/271; 269/281

(58) Field of Classification Search ..... 269/261, 269/263, 271, 279, 281
See application file for complete search history.

(56) References Cited

U.S. PATENT DOCUMENTS

| | | | | |
|---|---|---|---|---|
| 3,463,478 | A * | 8/1969 | Hennessey | 269/271 |
| 3,463,479 | A * | 8/1969 | Hennessey | 269/271 |
| 4,830,350 | A * | 5/1989 | Kuei | 269/279 |
| 5,244,194 | A * | 9/1993 | Nishimura | 269/155 |
| 5,419,540 | A * | 5/1995 | Teafatiller | 269/261 |
| 6,672,578 | B1 * | 1/2004 | Martens | 269/282 |
| 2009/0020937 | A1 * | 1/2009 | Odell | 269/271 |

* cited by examiner

*Primary Examiner* — David B Thomas
(74) *Attorney, Agent, or Firm* — Taft Stettinius & Hollister LLP

(57) ABSTRACT

A jaw plate for a vise including a selectively extendable pin for locating a workpiece. An exemplary jaw plate may be installed in a workholding device, such as a vise, which may be used to hold a workpiece proximate a machine tool. An exemplary jaw plate includes a plurality of pins at predetermined locations along the jaw plate's front face. The pins may be individually selectively extended or retracted by an operator. In their extended positions, the pins may assist the operator in locating the workpiece relative to the machine tool in a correct and repeatable position.

17 Claims, 9 Drawing Sheets

PIN STOP JAW PLATE

CROSS REFERENCE TO RELATED APPLICATIONS

This application claims the benefit of U.S. Provisional Application No. 61/126,597, filed May 5, 2008, which is incorporated by reference.

BACKGROUND

The present disclosure is directed to workholding devices and, more particularly, to removable jaws for vises, which may be used to hold workpieces for machine tools.

SUMMARY

Exemplary embodiments may include a jaw plate for a vise including a selectively extendable pin for locating a workpiece. An exemplary jaw plate may be installed in a workholding device, such as a vise, which may be used to hold a workpiece proximate a machine tool. An exemplary jaw plate includes a plurality of pins at predetermined locations along the jaw plate's front face. The pins may be individually selectively extended or retracted by an operator. In their extended positions, the pins may assist the operator in locating the workpiece relative to the machine tool in a correct and repeatable position.

In an aspect, a pin stop jaw plate for a vise may include a jaw plate for releasable mounting to a jaw of a vise, the jaw plate including a front face, a back face, and a hole extending through the jaw plate from the front face to the back face; and a pin slidably engaged with the hole such that, in a first position, the pin extends beyond the front face of the jaw plate and, in a second position, the pin does not extend beyond the front face of the jaw plate.

In a detailed embodiment, the hole may include a first hole extending from the front face and a second hole extending from the back face, the first hole and the second hole connecting within the jaw plate, the second hole may have a diameter greater than a diameter of the first hole, and the transition between the first hole and the second hole may form a shoulder. In a detailed embodiment, the first hole and the second hole may be coaxial. In a detailed embodiment, the pin may include a first section having a first diameter and a second section having a second diameter, the first diameter may correspond with the first hole and the second diameter may correspond with the second hole, and the shoulder may limit movement of the pin within the first hole and the second hole towards the front face. In a detailed embodiment, the first section and the second section may be arranged coaxially. In a detailed embodiment, a pin stop jaw plate may include an o-ring seated on the second section.

In a detailed embodiment, a pin stop jaw plate may include a slot accessible from the front face of the pin stop jaw plate and a parallel releasably engagable with the slot.

In a detailed embodiment, a plurality of holes housing a respective plurality of pins may be arranged linearly across the front face of the pin stop jaw plate. In a detailed embodiment, at least one of the holes may be marked with an identifying indicium. In a detailed embodiment, at least one of the holes may not be arranged linearly with the others of the plurality of holes. In a detailed embodiment, a first plurality of holes may be arranged linearly across the front face along a first line and a second plurality of holes may be arranged linearly along a second line, the first and second lines being non-parallel. In a detailed embodiment, a first plurality of holes may be arranged linearly across the front face along a first line and a second plurality of holes may be arranged linearly across the front face along a second line, the first line and the second line being spaced apart and parallel.

In a detailed embodiment, a pin stop jaw plate may include an o-ring at least partially interposing the pin and the hole. In a detailed embodiment, the o-ring may be mounted to the pin.

In an aspect, a jaw plate for a vise may include a generally rectangular plate for mounting to a jaw of a vise, the plate including a first face and at least one hole extending through the plate from the first face; and a pin slidably engaged with the hole, the pin extending beyond the first face of the plate in a first position and the pin not extending beyond the first face in a second position. The plate may include at least one mounting hole engagable with at least one of a fastener and a projection of a vise jaw.

In a detailed embodiment, the pin may include a first section having a first diameter and a second section having a second diameter, the second diameter being greater than the first diameter, the hole may include a first hole extending into the jaw plate from the first face and a second hole extending into the jaw plate from a second face, the second face being opposite the first face, the first hole and the second hole may join within the jaw plate, and the first hole may have a diameter for receiving the first section and the second hole may have a diameter for receiving the second section. In a detailed embodiment, the first section and the second section may be arranged coaxially. In a detailed embodiment, the pin may be slidably engaged with the hole such that the first section is oriented towards the first face and the second section is oriented away from the first face.

In an aspect, a method of using a pin stop jaw plate in a vise may include installing a pin stop jaw plate in a vise, the pin stop jaw plate including at least one slidable pin, the pin being selectively extendable from a front face of the jaw plate; extending the at least one pin from the front face of the jaw plate; placing a work piece adjacent to the front face of the jaw plate and laterally against the extended pin; and tightening the vise jaws to secure the work piece.

In a detailed embodiment, the pin may be a stepped pin, the hole may include an internal shoulder and the shoulder may be operative to limit movement of the pin in a direction towards the front face of the jaw plate. In a detailed embodiment, the method may include programming a machine tool using a known location of the at least one pin.

BRIEF DESCRIPTION OF THE DRAWINGS

The detailed description refers to the following figures in which.

DETAILED DESCRIPTION

Figure 1:
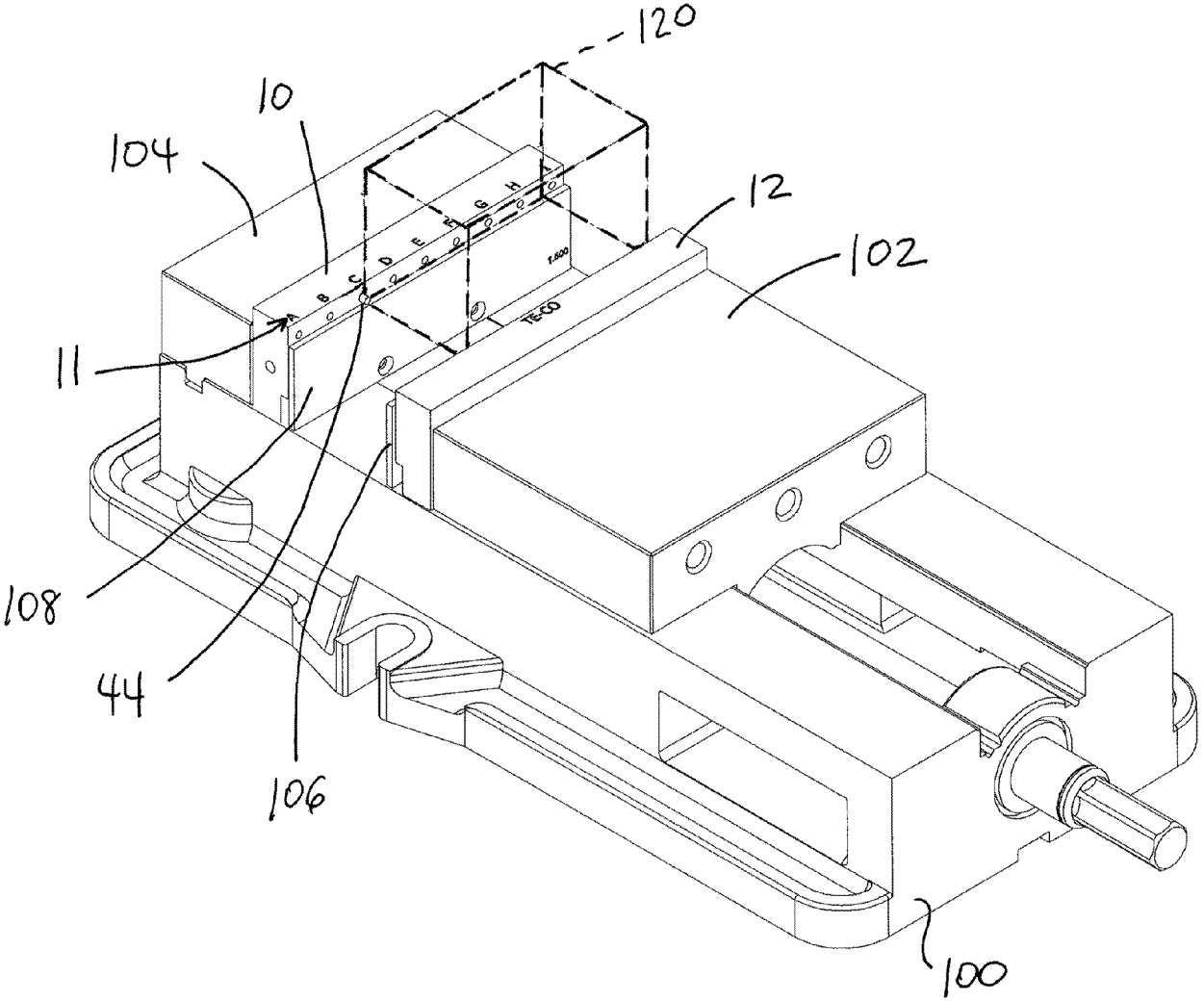
FIG. 1 is a perspective view of a vise including an exemplary pin stop jaw plate.

As shown in FIG. 1, a vise 100 (such as, but not limited to, a conventional 6-inch single station vise) may include a plurality of jaws 102, 104, such as a moveable jaw 102 and a fixed jaw 104, which may be used to hold a work piece 120 (shown in phantom). An exemplary jaw plate 10, 12 according to the present disclosure may be mounted to each of the vise jaws 102, 104 using, for example socket head cap screws. The jaw plates 10, 12 may be sized to fit any vise 100 having a standard bolt pattern. Parallels 106, 108 may be attached to the jaw plates 10, 12.

FIGS. 2 and 3A-3C depict an exemplary pin stop jaw plate 10 according to the present disclosure. The exemplary pin stop jaw plate 10 includes mounting holes 14, 16 for mounting the jaw plate 10 to the fixed jaw 104. Mounting holes 14, 16 may have chamfered edges and may include portions having different diameters. Back face 20 may be mounted against fixed jaw 104. In addition, pin stop jaw plate 10 may include a slot 82, which may be located adjacent to a bottom edge of the jaw plate 10, for attachment of a parallel 106, 108 or another similar device, such as a mill angle. Exemplary parallels 106, 108 may be installed and removed without tools using only the operator's finger pressure, for example.

Figure 2:
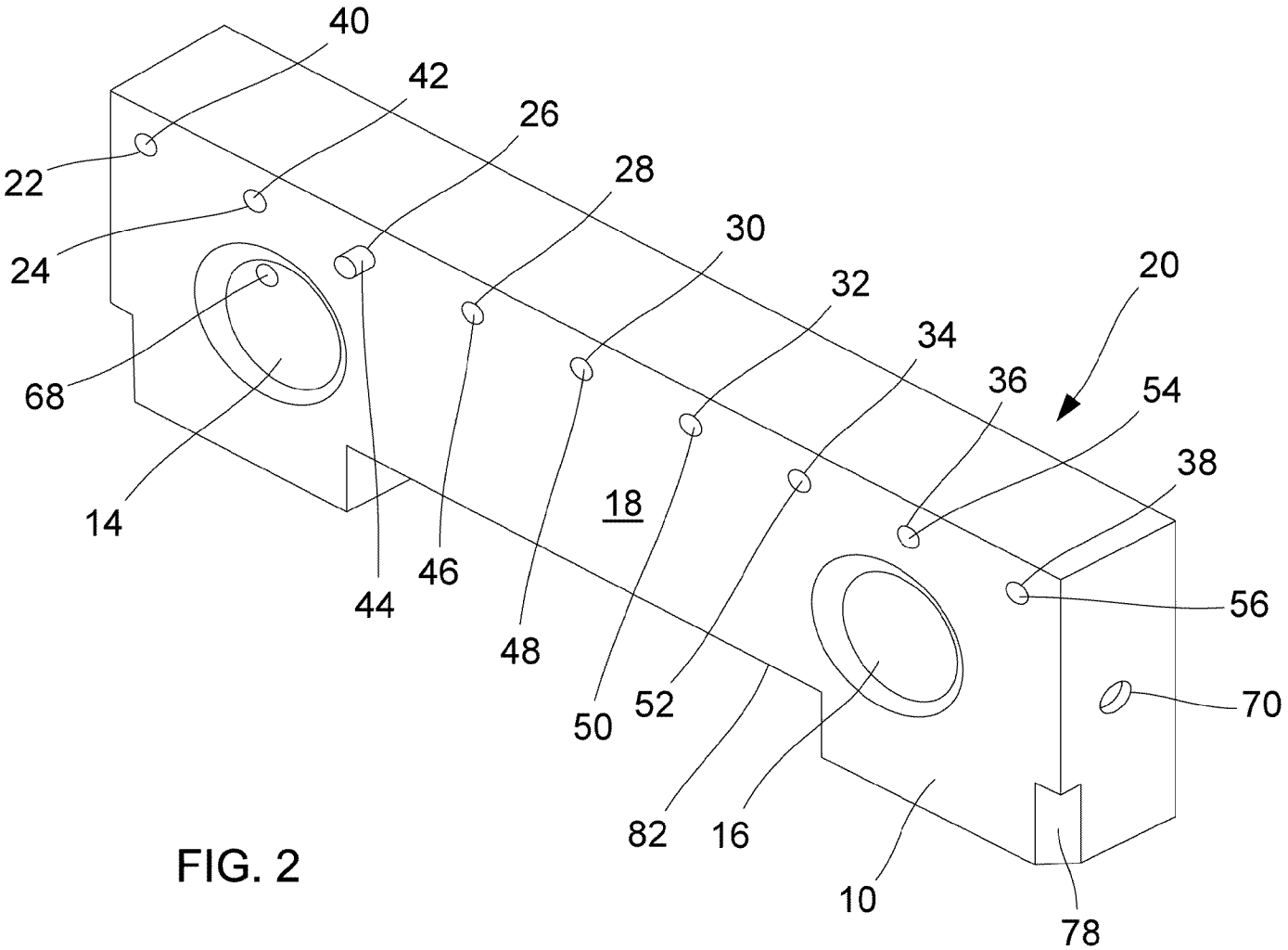
FIG. 2 is a perspective view of an exemplary pin stop jaw plate.

In an exemplary embodiment, holes 22, 24, 26, 28, 30, 32, 34, 36, 38 are located on front face 18 of jaw plate 10. Each of holes 22, 24, 26, 28, 30, 32, 34, 36, 38 houses a pin 40, 42, 44, 46, 48, 50, 52, 54, 56. In FIG. 2, pin 44 is shown in an extended position (pin 44 extends substantially beyond front face 18) while the remaining pins 40, 42, 46, 48, 50, 52, 54, 56 are shown in the retracted position (pins 40, 42, 46, 48, 50, 52, 54, 56 do not extend beyond front face 18). While the exemplary embodiment shown in FIG. 2 includes nine holes housing nine pins in a horizontal linear arrangement, it is within the scope of the disclosure include more or fewer pins in a linear or other arrangement. For example, one or more pins may be spaced vertically relative to each other. See, for example, FIGS. 6 and 7, which show alternative exemplary arrangements of pins.

Figure 6:
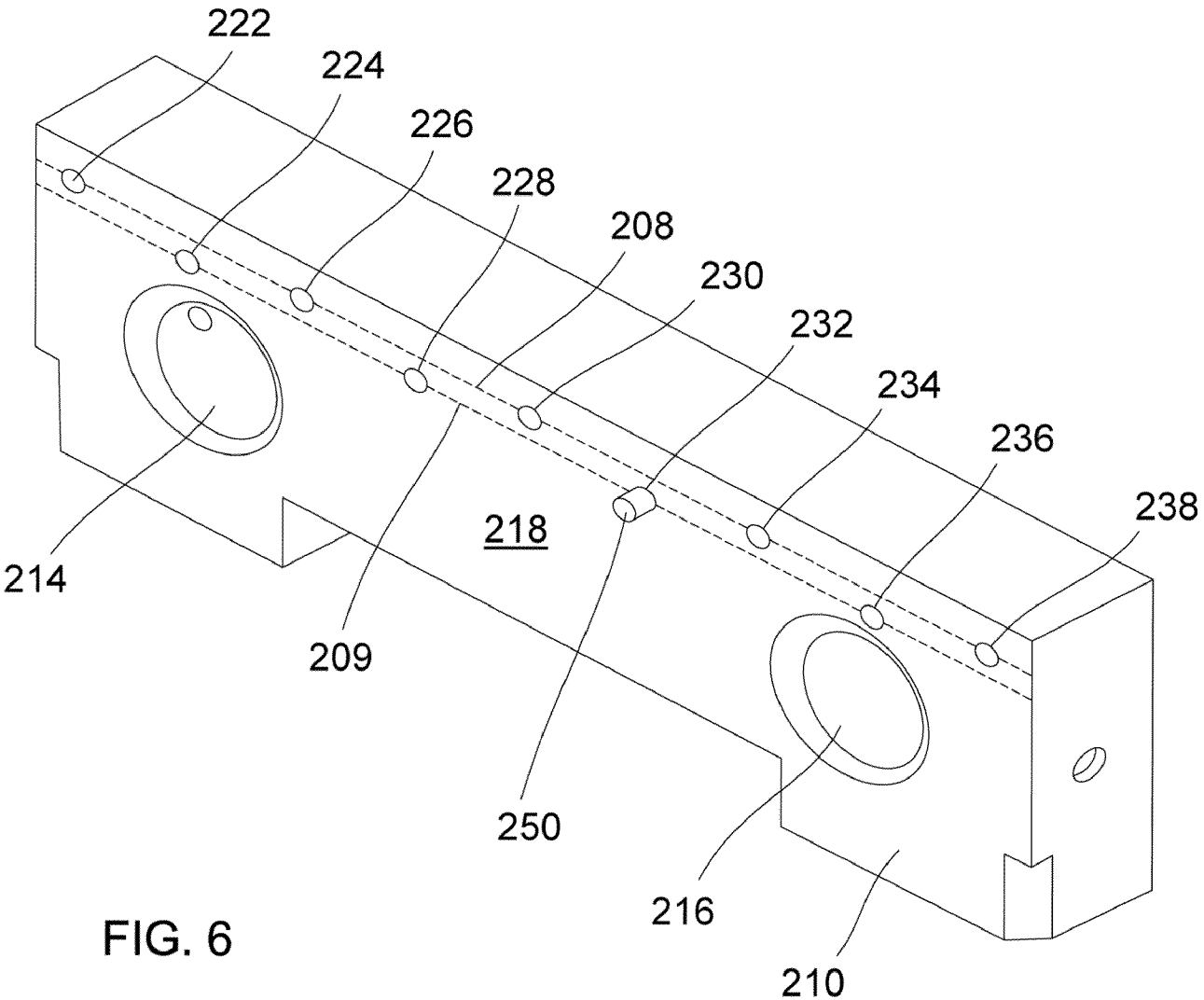
FIG. 6 is a perspective view of an exemplary pin stop jaw plate including an alternative pin arrangement.

FIG. 6 shows jaw plate 210 which includes 9 holes 222, 224, 226, 228, 230, 232, 234, 236, 238 (each housing a corresponding pin similar to pin 250) in addition to mounting holes 214 and 216. The 9 holes 222, 224, 226, 228, 230, 232, 234, 236, 238 are arranged along two vertically separated, parallel lines 208, 209 on face 218 of jaw plate 210.

Figure 7:
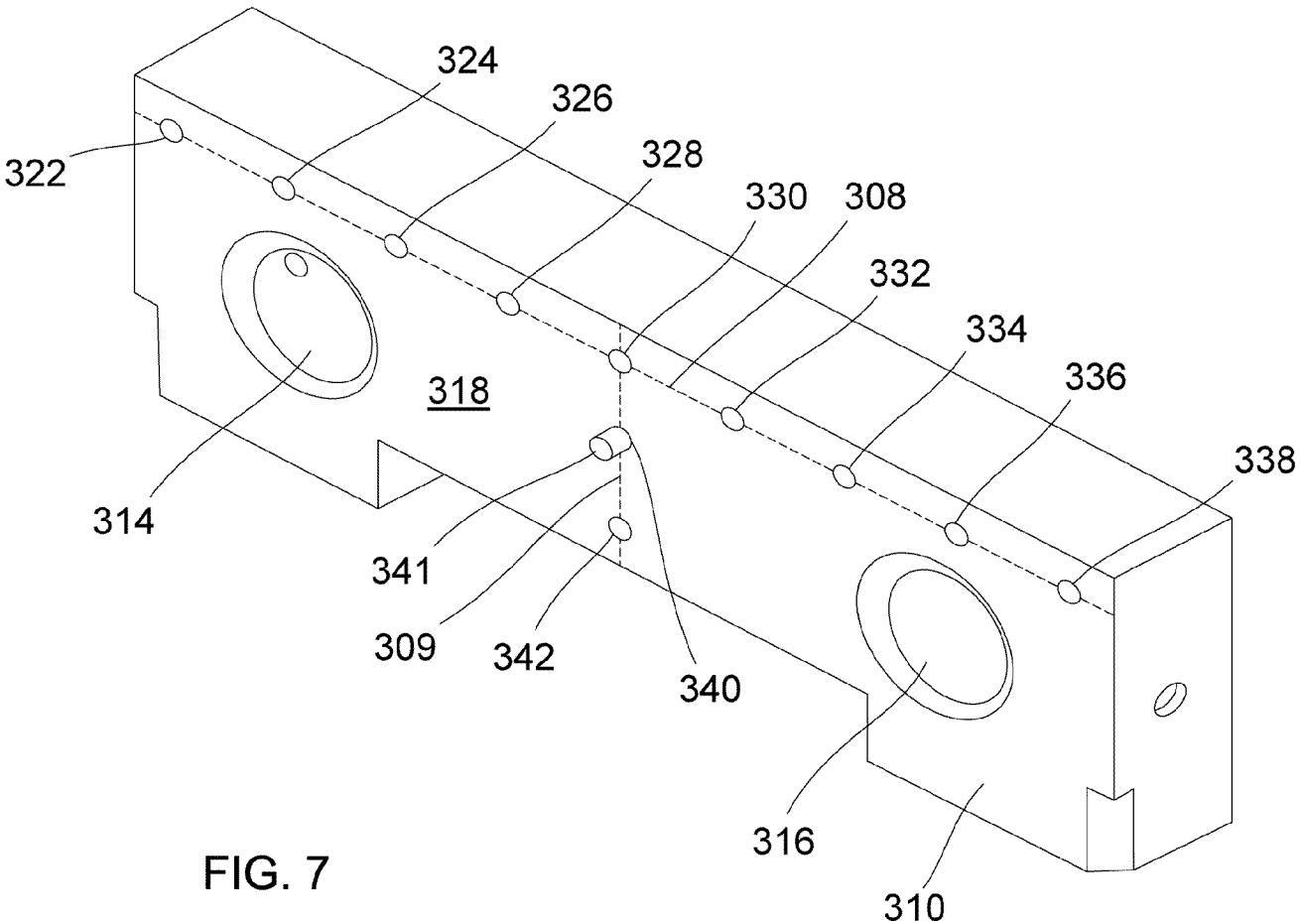
FIG. 7 is a perspective view of an exemplary pin stop jaw plate including an alternative pin arrangement.

FIG. 7 shows another alternative exemplary arrangement in which holes 322, 324, 326, 328, 330, 332, 334, 336, 338 are arranged linearly on face 318 of jaw plate 310 along line 308. Holes 340, 342 are located vertically beneath hole 330 between mounting holes 314, 316 along line 309. In this exemplary embodiment, lines 308, 309 are non-parallel and intersect at hole 330, although it is within the scope of the disclosure for such non-parallel lines to intersect at any position either on or not on face 318. Each of the holes 322, 324, 326, 328, 330, 332, 334, 336, 338, 340, 342 may include a pin, such as pin 341. Generally, it is within the scope of the disclosure to locate one or more holes at any location on jaw plate 10 and it is not necessary that any or all of the holes is arranged linearly.

Figure 3C:
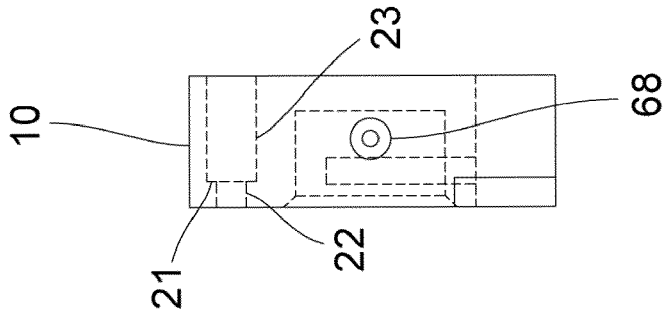
FIG. 3C is a side elevation view of an exemplary pin stop jaw plate.
Figure 3A:
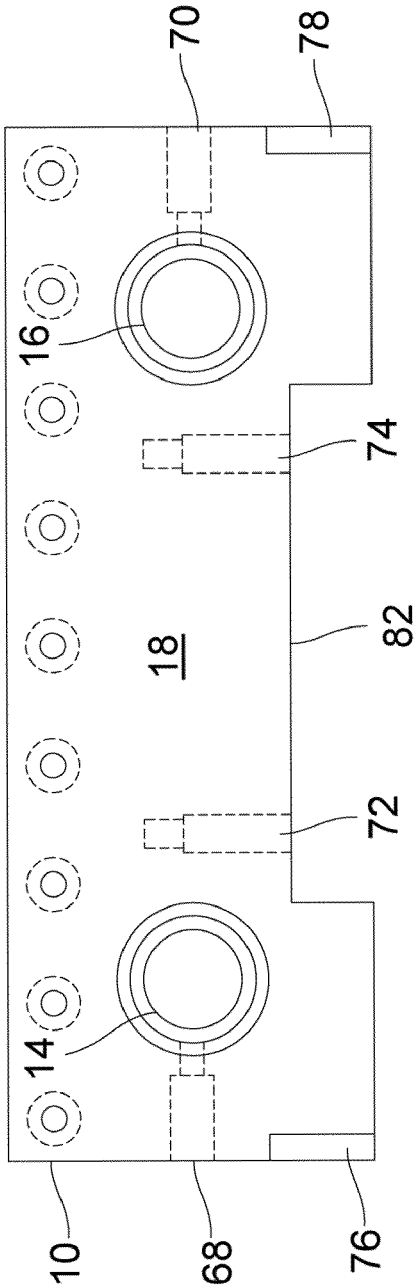
FIG. 3A is a front elevation view of an exemplary pin stop jaw plate.
Figure 3B:
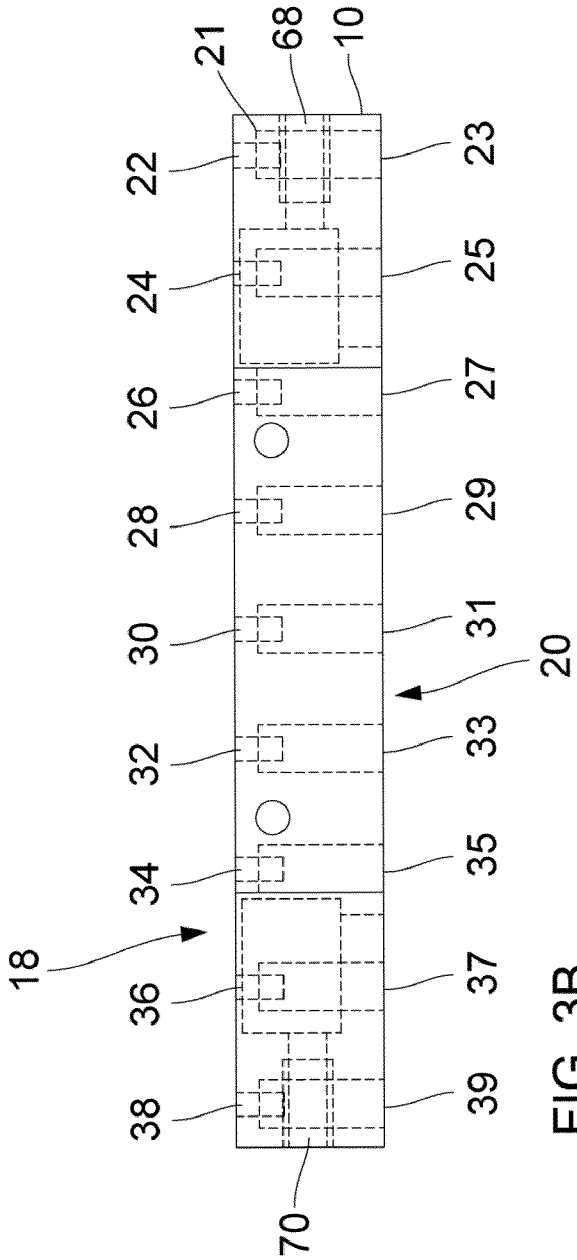
FIG. 3B is a bottom view of an exemplary pin stop jaw plate.

FIGS. 3A-3C depict an exemplary jaw plate 10 without pins 40, 42, 44, 46, 48, 50, 52, 54, 56 installed. Each of holes 22, 24, 26, 28, 30, 32, 34, 36, 38 connects to one of holes 23, 25, 27, 29, 31, 33, 35, 37, 39, which may have a larger diameter than holes 22, 24, 26, 28, 30, 32, 34, 36, 38. As shown in FIGS. 3B and 3C, the location where a hole 22, 24, 26, 28, 30, 32, 34, 36, 38 joins a hole 23, 25, 27, 29, 31, 33, 35, 37, 39 having a different diameter may form a shoulder 21.

An exemplary jaw plate 10 may also include holes 68, 70, which may be partially or fully threaded and/or may include portions having different diameters. Holes 68 and 70 may be used, for example, for attaching an additional work stop or aligning the jaw. See, for example, FIG. 8 which shows a side work stop 101 mounted to jaw plate 10 using hole 68. Some corners of jaw plate 10 may be chamfered, such as chamfers 76, 78. Further, other holes, such as holes 72, 74, may be provided and may include thread portions and/or portions having different diameters. Holes 72, 74 may be used, for example, for securing or affixing a parallel attachment 108 to the jaw plate 10.

Figure 4A:
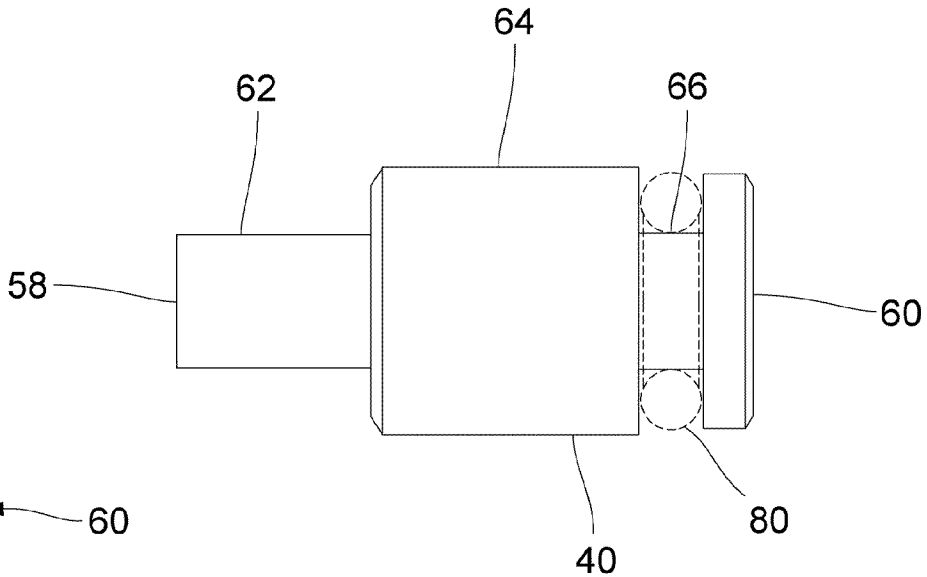
FIG. 4A is a side elevation view of an exemplary pin for a pin stop jaw plate.
Figure 4B:
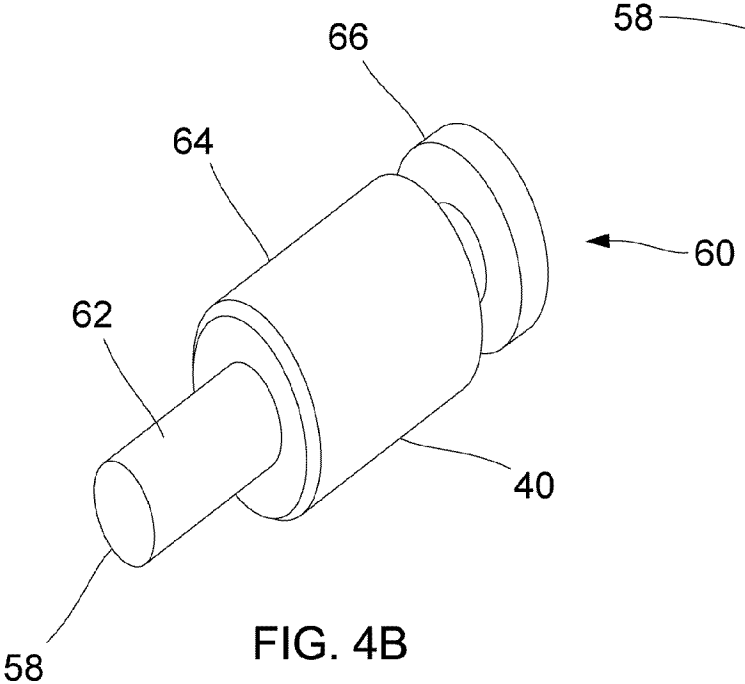
FIG. 4B is a perspective view of an exemplary pin for a pin stop jaw plate.

FIGS. 4A and 4B depict an exemplary pin 40, which is identical to pins 42, 44, 46, 48, 50, 52, 54, 56 in an exemplary embodiment. While the exemplary pins 40, 42, 44, 46, 48, 50, 52, 54, 56 are all identical, it is within the scope of the disclosure to utilize pins of more than one shape and/or size (as well as corresponding holes of other shapes and/or sizes) in an embodiment.

Exemplary pin 40 includes a front end 58 and a back end 60. Pin 40 is a stepped pin in that it includes a narrow section 62 (sized to fit through hole 22) and wide section 64 (sized to fit through hole 23). O-ring 80 (shown in phantom in FIG. 4A and not shown in FIG. 4B) is sized to provide a friction fit within hole 23 such that pin 40 is slidable within holes 22, 23, but does not move without an externally applied force. Other exemplary embodiments may include friction members other than an o-ring, and any friction member may be mounted to either or both of the pin and the jaw plate. It is within the scope of the disclosure to incorporate one or more pins having non-circular cross sections. Further, it is within the scope of the disclosure to incorporate other pin retaining devices (such as, but not limited to, set screws and spring detent mechanisms) in addition to or in place of the o-rings or other friction members to resist undesired movement of the pins within the jaw plate.

Figure 5A:
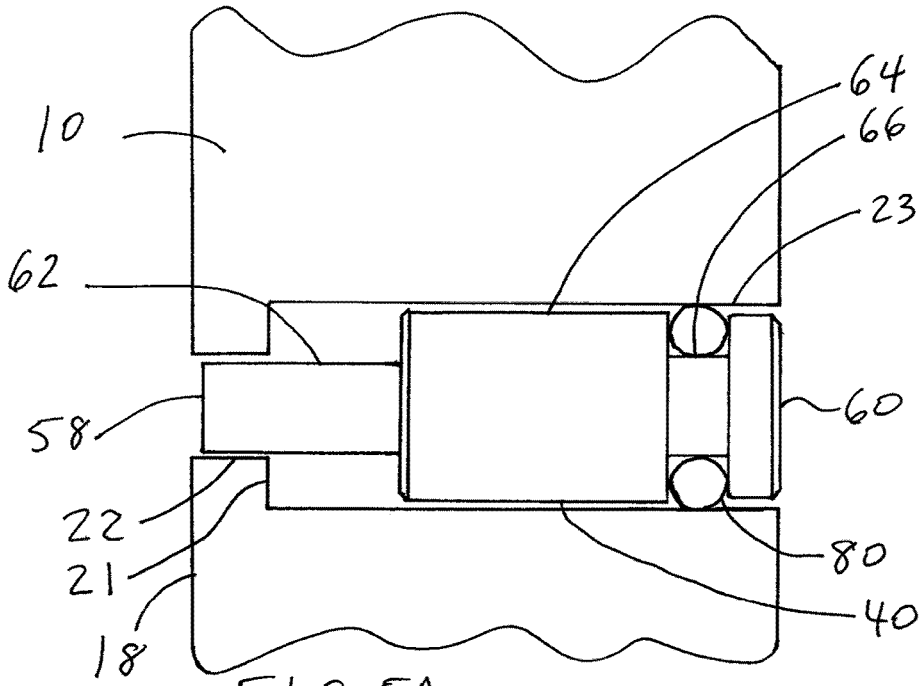
FIG. 5A is a cross-sectional view of an exemplary pin installed in a pin stop jaw plate in a retracted position.
Figure 5B:
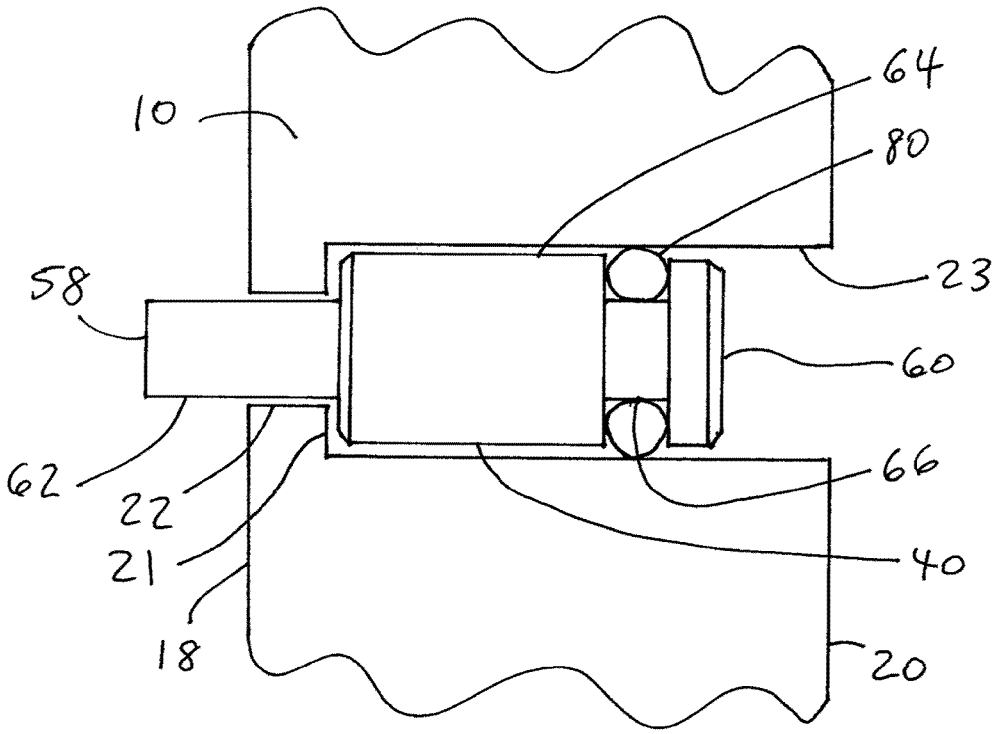
FIG. 5B is a cross-sectional view of an exemplary pin installed in a pin stop jaw plate in an extended position.

FIGS. 5A and 5B depict the operation of an exemplary embodiment. In FIG. 5A, pin 40 is in the retracted position such that front end 58 does not extend beyond front face 18 of jaw plate 10 (front end 58 may be flush with front face 18 or may be recessed). In FIG. 5B, pin 40 is in the extended position such that front end 58 and part of narrow section 62 extend beyond front face 18. Pin 40 may be moved between the retracted and extended positions as desired by a user by applying a generally axial force to pin 40 by pushing on either of front end 58 or back end 60. In an exemplary embodiment, the travel of pin 40 in the direction of its front end 58 may be limited by wide portion 64 contacting shoulder 21.

Figure 8:
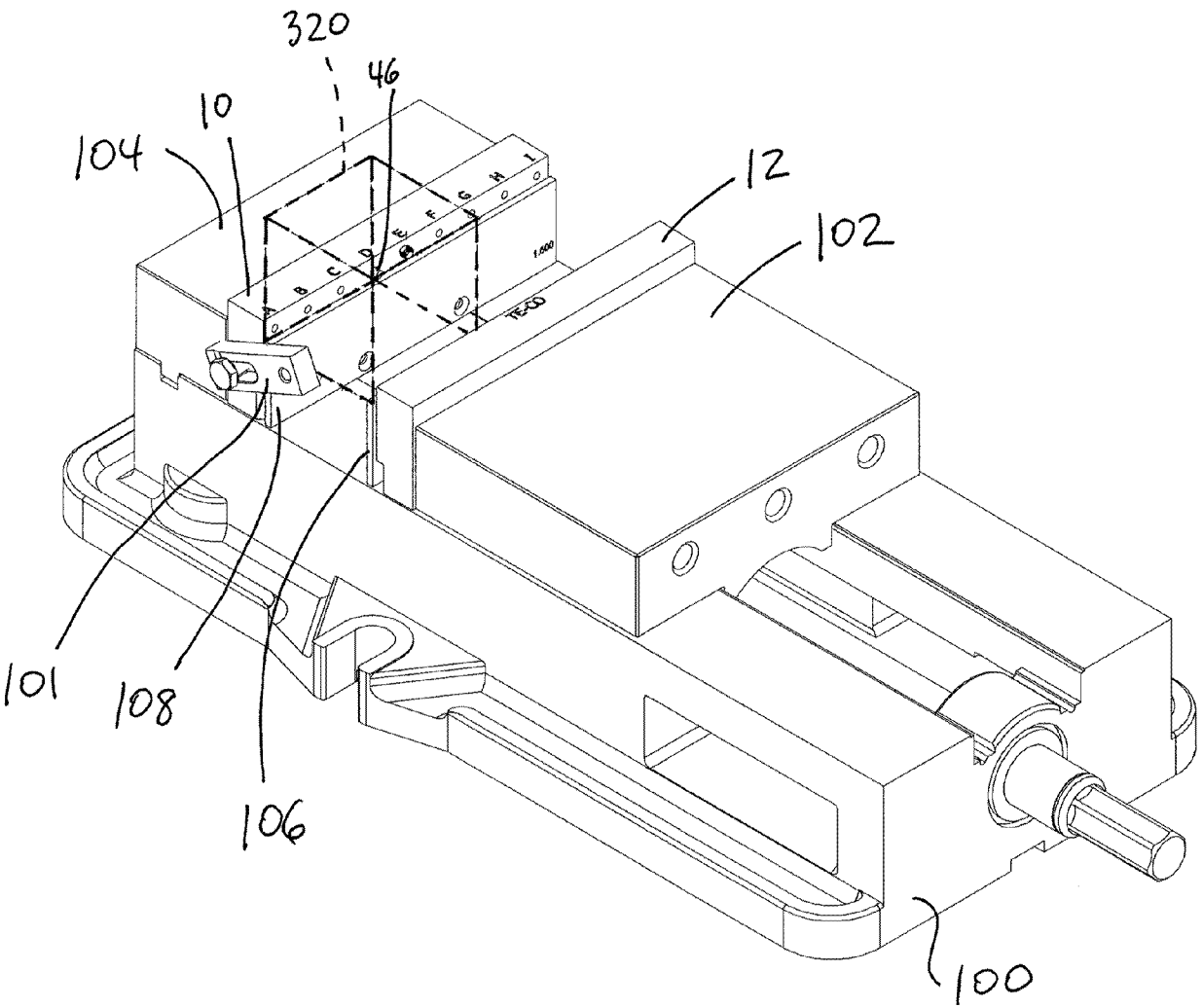
FIG. 8 is a perspective view of a vise including an exemplary pin stop jaw plate with a side work stop.
Figure 9:
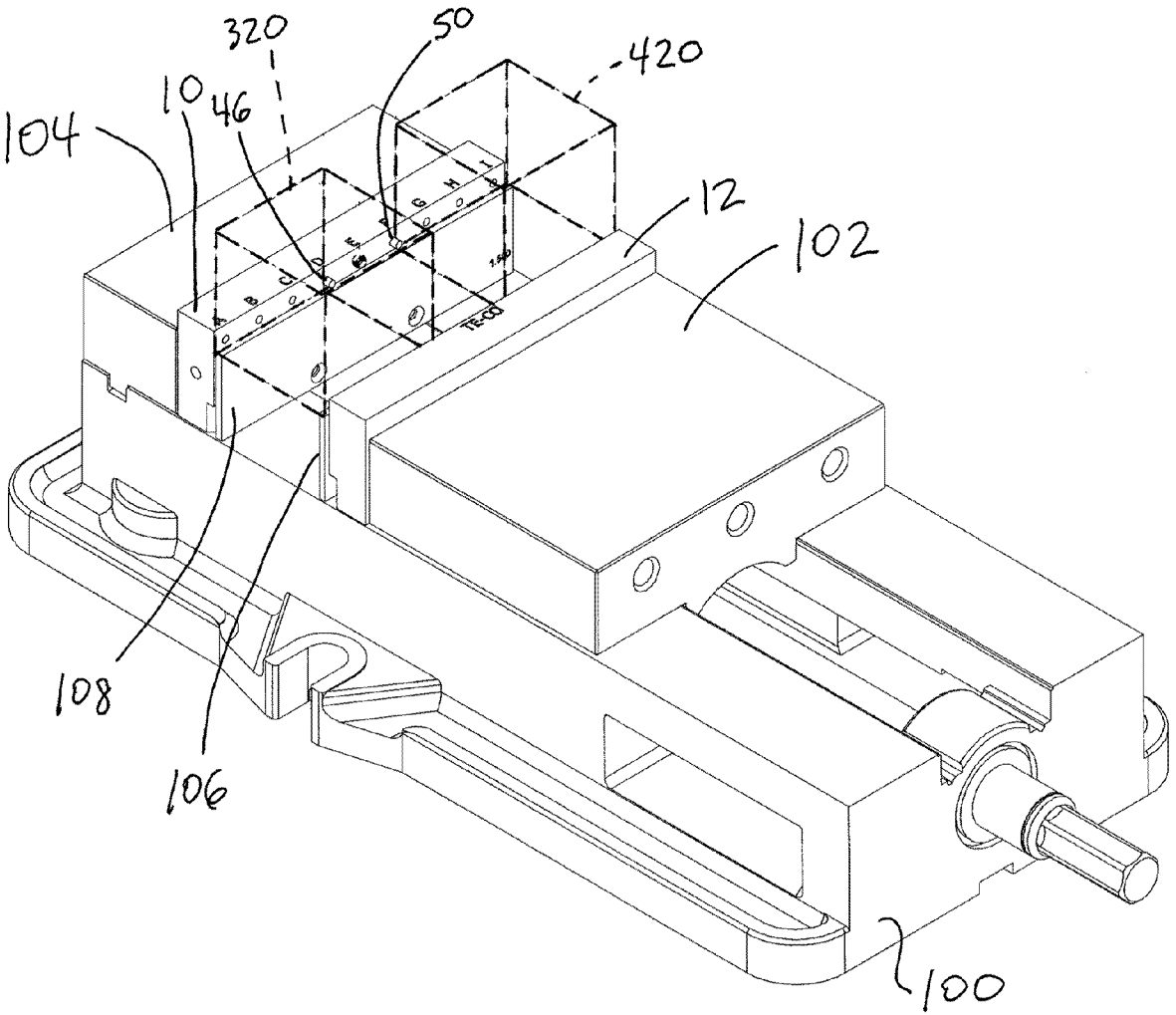
FIG. 9 is a perspective view of a vise including an exemplary pin stop jaw plate holding two workpieces.

When mounted to a vise 100, one or more of pins 40, 42, 44, 46, 48, 50, 52, 54, 56 of jaw plate 10 may function as a built-in work stop. The narrow section 62 protruding through the front face 18 of the jaw plate 10 may provide a known and repeatable location for a work piece 120 held within the vise 100. See FIG. 1, which shows pin 44 extended and functioning as a work stop, and FIG. 8, which shows pin 46 extended and functioning as a work stop. More than one pin 40, 42, 44, 46, 48, 50, 52, 54, 56 may be extended if desired. For example, FIG. 9 shows pins 46, 50 extended when using the vise 100 is used to hold two work pieces 320, 420.

Utilizing built-in pins 40, 42, 44, 46, 48, 50, 52, 54, 56 may eliminate the need to employ a separate work stop, and it may allow easily repeatable positioning of the work piece 120. In addition, in some exemplary embodiments, the pins 40, 42, 44, 46, 48, 50, 52, 54, 56 may be extended or retracted without tools using only force applied by an operator's finger.

It is within the scope of the disclosure to utilize another work stop in conjunction with one or more of the built-in pins 40, 42, 44, 46, 48, 50, 52, 54, 56. For example, FIG. 8 shows a side work stop (which may be attached to hole 68, for example) and pin 46 holding work piece 320.

Further, because the locations of the pins 40, 42, 44, 46, 48, 50, 52, 54, 56 on the jaw plate 10 may be known to a machine programmer, the machine programmer may use the known positions of the pins as starting points for programming a machine tool. In an exemplary embodiment depicted in FIG. 3A, the pins 40, 42, 44, 46, 48, 50, 52, 54, 56 are located 0.225 inches below the top edge of the jaw plate (1.625 inches above the bottom edge of the jaw plate) and are spaced horizontally 0.688 inches, 1.375 inches, 2.062 inches, and 2.750 inches from center pin 48.

The pins 40, 42, 44, 46, 48, 50, 52, 54, 56 (or jaw plate 10) may be labeled with identifying indicia such as, but not limited to, the letters 11 shown in FIG. 1. A machine programmer may provide set-up instructions to a machine operator including which of the pins 40, 42, 44, 46, 48, 50, 52, 54, 56 should be extended when machining a particular work piece 120.

Exemplary jaw plates may be constructed from hardened steel or other suitable materials. Pins 40 may also be constructed from a steel or other suitable material. O-rings and other friction members may be constructed from appropriate materials, such as elastic materials.

It is within the scope of the disclosure to utilize a pin stop jaw plate on other workholding devices such as, but not limited to, other types of vises. Further, it is within the scope of the disclosure to utilize a jaw plate 10 having pins 40, 42, 44, 46, 48, 50, 52, 54, 56 on one or more of the moveable jaws 102 and fixed jaws 104 in a vise 100. For example, a jaw plate 10 having one or more pins 40, 42, 44, 46, 48, 50, 52, 54, 56 may be utilized in each of the two stations in a two station vise. In certain embodiments, jaw plates, parallels, and similar workholding components may include nonrectangular portions (such as, but not limited to, angled portions) for holding nonrectangular work pieces and/or for holding work pieces in orientations other than in parallel with the vise jaws and/or the supporting surface.

While exemplary embodiments have been set forth above for the purpose of disclosure, modifications of the disclosed embodiments as well as other embodiments thereof may occur to those skilled in the art. Accordingly, it is to be understood that the disclosure is not limited to the above precise embodiments and that changes may be made without departing from the scope. Likewise, it is to be understood that it is not necessary to meet any or all of the stated advantages or objects disclosed herein to fall within the scope of the disclosure, since inherent and/or unforeseen advantages may exist even though they may not have been explicitly discussed herein.

What is claimed is:

1. A pin stop jaw plate for a vise comprising: a jaw plate for releasable mounting to a jaw of a vise, the jaw plate including a front face, a back face, and a hole extending through the jaw plate from the front face to the back face; and a pin slidably engaged with the hole such that, in a first position, the pin extends beyond the front face of the jaw plate and, in a second position, the pin does not extend beyond the front face of the jaw plate, wherein the hole includes a first hole extending from the front face and a second hole extending from the back face, the first hole and the second hole connecting within the jaw plate; wherein the second hole has a diameter greater than a diameter of the first hole; and wherein the transition between the first hole and the second hole forms a shoulder.

2. The pin stop jaw plate of claim 1, wherein the first hole and the second hole are coaxial.

3. The pin stop jaw plate of claim 1, wherein the pin includes a first section having a first diameter and a second section having a second diameter, wherein the first diameter corresponds with the first hole and the second diameter corresponds with the second hole; and wherein the shoulder limits movement of the pin within the first hole and the second hole towards the front face.

4. The pin stop jaw plate of claim 3, wherein the first section and the second section are arranged coaxially.

5. The pin stop jaw plate of claim 3, further comprising an o-ring seated on the second section.

6. A pin stop jaw plate for a vise comprising: a jaw plate for releasable mounting to a jaw of a vise, the jaw plate including a front face, a back face, and a hole extending through the jaw plate from the front face to the back face; and a pin slidably engaged with the hole such that, in a first position, the pin extends beyond the front face of the jaw plate and, in a second position, the pin does not extend beyond the front face of the jaw plate, the pin stop jaw plate further comprising a slot accessible from the front face of the pin stop jaw plate; and a parallel releasably engagable with the slot.

7. The pin stop jaw plate of claim 6, wherein a plurality of holes housing a respective plurality of pins are arranged linearly across the front face of the pin stop jaw plate.

8. The pin stop jaw plate of claim 7, wherein at least one of the holes is marked with an identifying indicium.

9. The pin stop jaw plate of claim 7, wherein at least one of the holes is not arranged linearly with the others of the plurality of holes.

10. The pin stop jaw plate of claim 9, wherein a first plurality of holes is arranged linearly across the front face along a first line and a second plurality of holes is arranged linearly along a second line, the first and second lines being non-parallel.

11. The pin stop jaw plate of claim 9, wherein a first plurality of holes is arranged linearly across the front face along a first line and a second plurality of holes is arranged linearly across the front face along a second line, the first line and the second line being spaced apart and parallel.

12. A pin stop jaw plate for a vise comprising: a jaw plate for releasable mounting to a jaw of a vise, the jaw plate including a front face, a back face, and a hole extending through the jaw plate from the front face to the back face; and a pin slidably engaged with the hole such that, in a first position, the pin extends beyond the front face of the jaw plate and, in a second position, the pin does not extend beyond the front face of the jaw plate, the pin stop jaw plate and further comprising an o-ring at least partially interposing the pin and the hole.

13. The pin stop jaw plate of claim 12, wherein the o-ring is mounted to the pin.

14. A jaw plate for a vise comprising: a generally rectangular plate for mounting to a jaw of a vise, the plate including a first face and at least one hole extending through the plate from the first face; and a pin slidably engaged with the hole, the pin extending beyond the first face of the plate in a first position and the pin not extending beyond the first face in a second position; wherein the plate includes at least one mounting hole engagable with at least one of a fastener and a projection of a vise jaw wherein the pin includes a first section having a first diameter and a second section having a second diameter, the second diameter being greater than the first diameter; wherein the hole includes a first hole extending into the jaw plate from the first face and a second hole extending into the jaw plate from a second face, the second face being opposite the first face; wherein the first hole and the second hole join within the jaw plate; and wherein the first hole has a diameter for receiving the first section and the second hole has a diameter for receiving the second section.

15. The jaw plate of claim 14, wherein the first section and the second section are arranged coaxially.

16. The jaw plate of claim 14, wherein the pin is slidably engaged with the hole such that the first section is oriented towards the first face and the second section is oriented away from the first face.

17. A method of using a pin stop jaw plate in a vise comprising the steps of: installing a pin stop jaw plate in a vise, the pin stop jaw plate including at least one slidable pin, the pin being selectively extendable from a front face of the jaw plate; extending the at least one pin from the front face of the jaw plate; placing a work piece adjacent to the front face of the jaw plate and laterally against the extended pin; and tightening the vise jaws to secure the work piece and wherein the pin is a stepped pin; wherein the hole includes an internal shoulder; and wherein the shoulder is operative to limit movement of the pin in a direction towards the front face of the jaw plate.

* * * * *